United States Patent [19]

D'Amato

[11] 3,981,641

[45] Sept. 21, 1976

[54] HYDRAULIC MOTOR WITH ORBITING DRIVE MEMBER

[76] Inventor: Michael A. D'Amato, 1200 E. Main St., Waukesha, Wis. 53186

[22] Filed: Oct. 8, 1975

[21] Appl. No.: 620,697

[52] U.S. Cl. ..... 418/61 R; 418/77; 418/81; 418/82; 418/102; 418/133; 418/186

[51] Int. Cl.[2] ..... F01C 1/02; F01C 21/00; F01C 19/08; F01C 21/04

[58] Field of Search ..... 418/61 R, 77, 81, 82, 418/102, 186, 131, 133

[56] References Cited

UNITED STATES PATENTS

| | | | |
|---|---|---|---|
| 1,079,561 | 11/1913 | Kinney | 418/102 |
| 2,544,988 | 3/1951 | Gardiner et al. | 418/77 |
| 3,516,765 | 6/1970 | Boyadjieff et al. | 418/61 R |
| 3,606,599 | 9/1971 | Verge et al. | 418/61 R |
| 3,703,344 | 11/1922 | Reitter | 418/61 R |
| 3,736,078 | 5/1973 | Read et al. | 418/61 R |
| 3,901,630 | 8/1975 | Kilmer | 418/61 R |

*Primary Examiner*—John J. Vrablik

[57] ABSTRACT

A working member, i.e., an eccentric drive ring having internal teeth, orbits about a driven pinion having a lesser number of teeth to achieve gear reduction. Hydraulically expressed divider vanes on the orbiting drive ring engage the inner periphery of a surrounding fixed ring to define working chambers between the outer periphery of the drive ring and the inner periphery of the fixed ring. Port plates on opposite sides of the drive ring are respectively exposed to high and low pressure fluid. Valving occurs when slots on opposite sides of the drive ring are exposed to ports on the port plate as the result of the orbital movement of the drive ring, so as to establish fluid flow paths to and from the working chambers.

7 Claims, 19 Drawing Figures

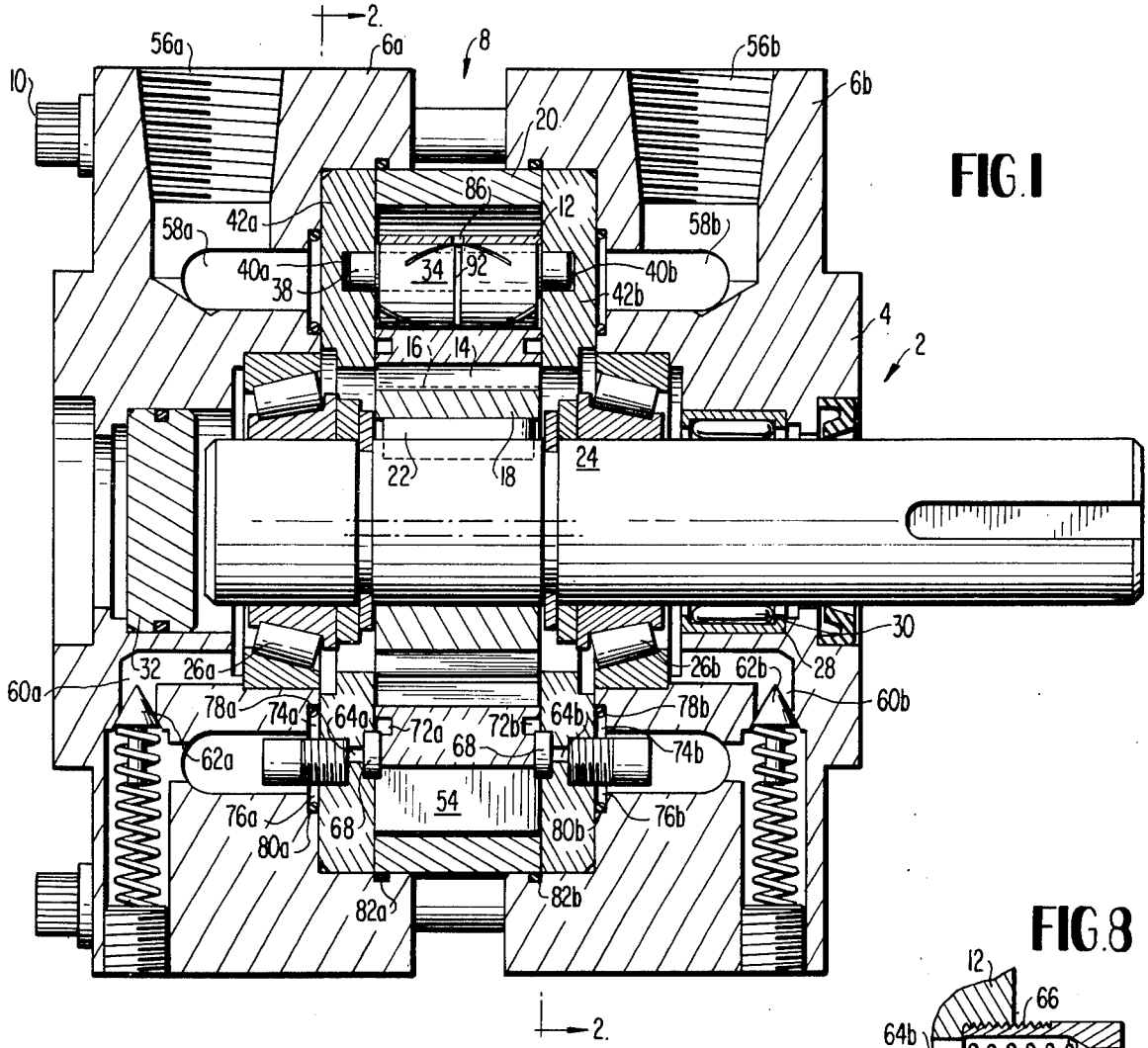
FIG. 1
FIG. 8
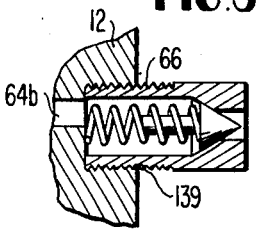
FIG. 6
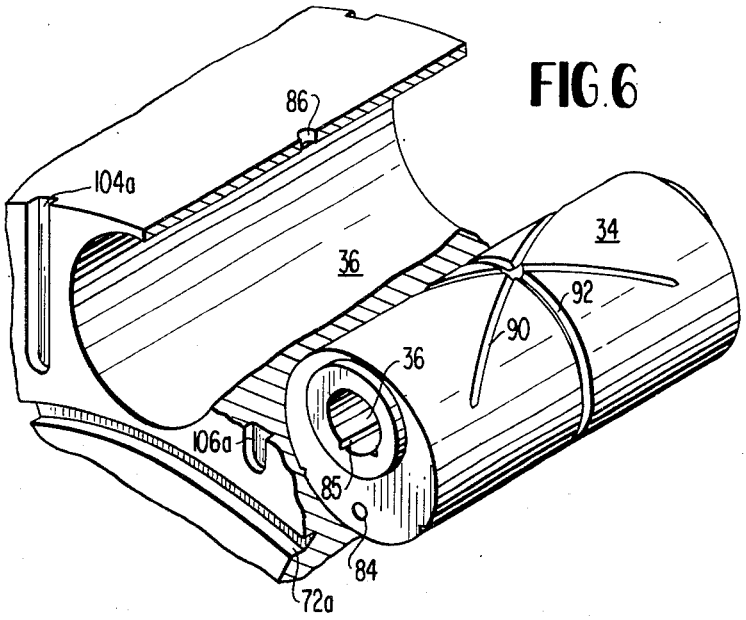
FIG. 7
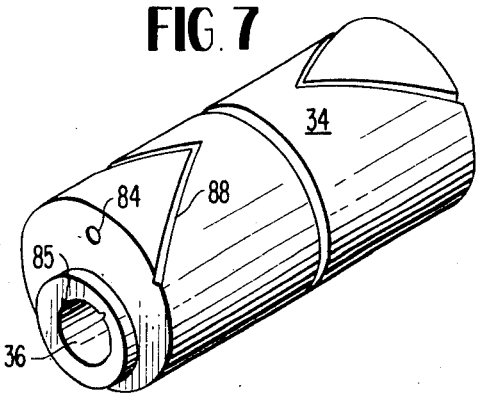

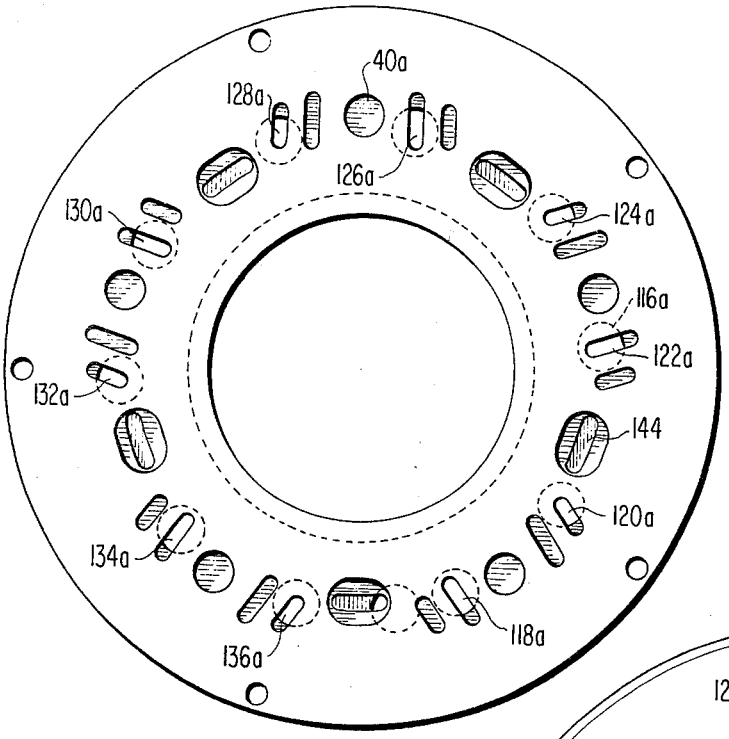
FIG. 3
FIG. 4
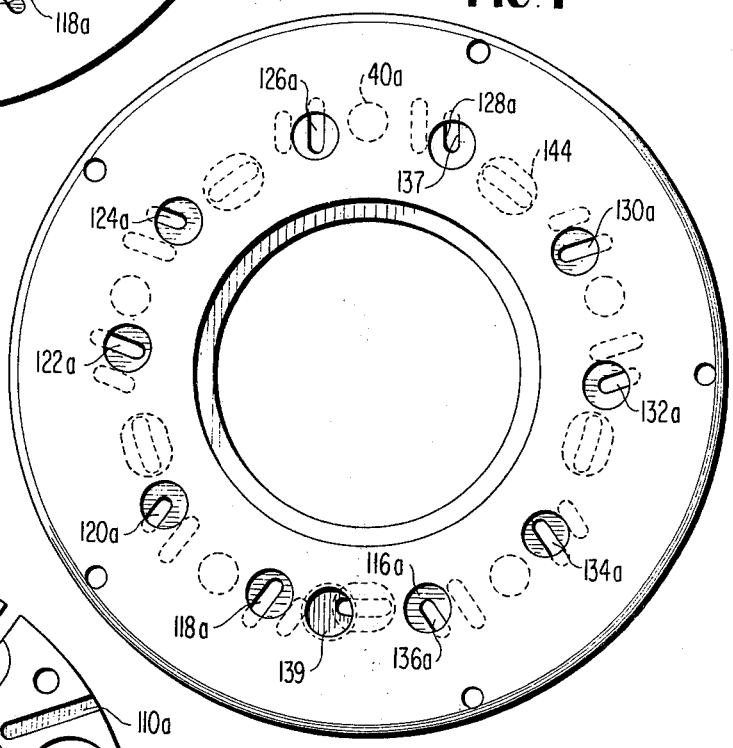
FIG. 5
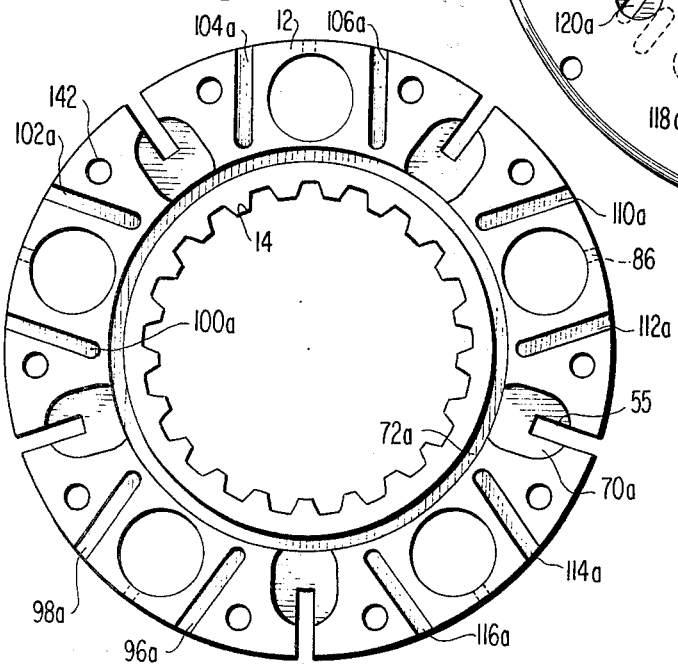

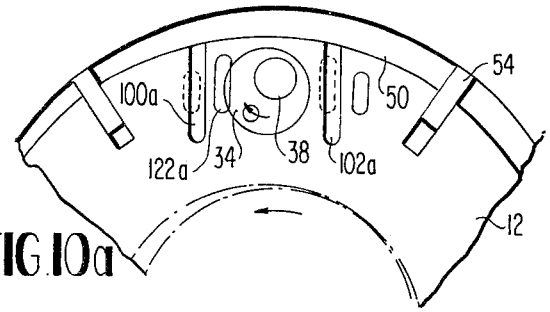
FIG. 10a
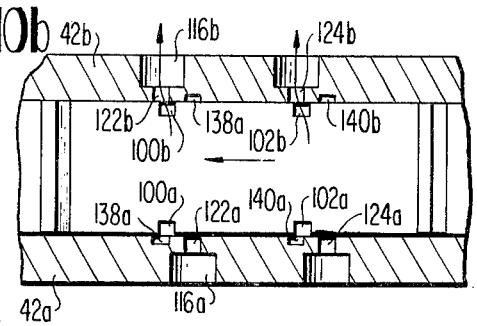
FIG. 10b
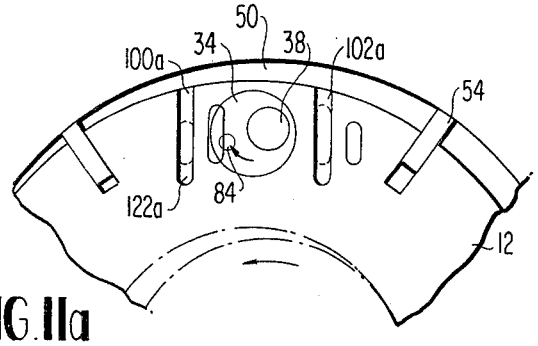
FIG. 11a
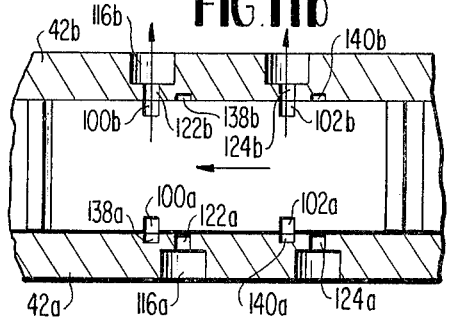
FIG. 11b
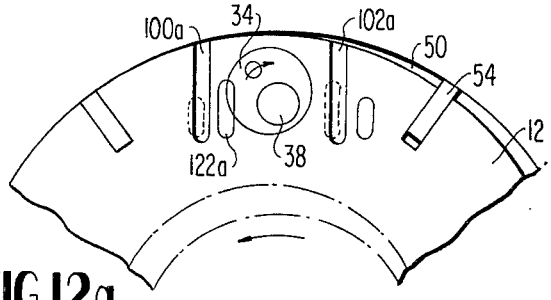
FIG. 12a
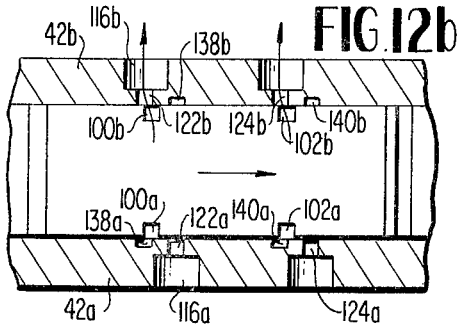
FIG. 12b
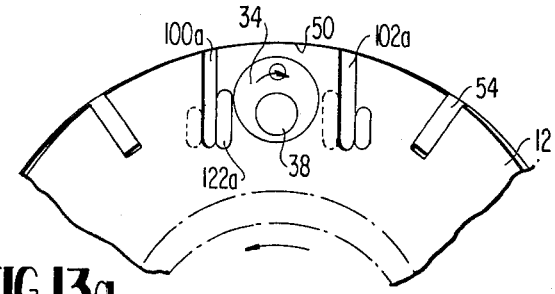
FIG. 13a
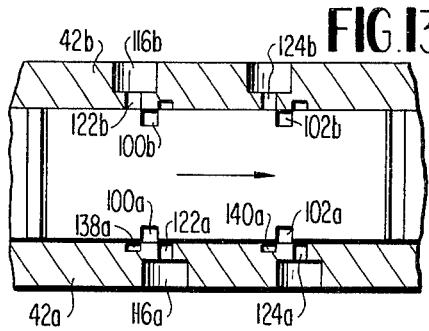
FIG. 13b
FIG. 14a
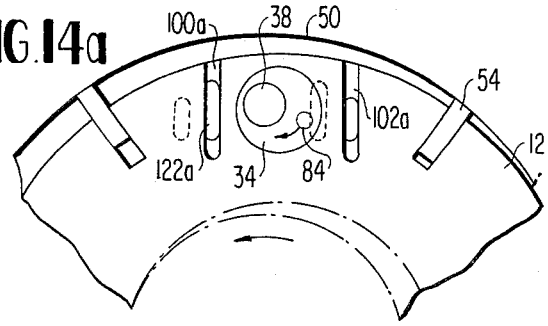
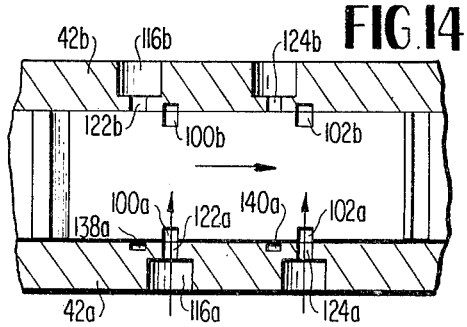
FIG. 14b

HYDRAULIC MOTOR WITH ORBITING DRIVE MEMBER

FIELD OF INVENTION

Rotary Expansible Chamber Devices, Working Member Has Planetating Movement, With relatively movable partition members, slidable in working member.

PRIOR ART

Charlson U.S. Pat. No. 2,989,951; Boyedjieff et al U.S. Pat. No. 3,516,765; Bowman U.S. Pat. No. 3,589,243; Chambers U.S. Pat. No. 3,613,510; and Kilmer U.S. Pat. No. 3,796,525.

OBJECTS

The primary object of this invention is to provide a low speed, high torque hydraulic motor having a smooth uncogging rotary output motion. More particularly, it is intended to provide a hydraulic motor having an orbiting working member which undergoes relatively high-speed orbital movements, but whose output shaft is driven relatively slowly through an internal reduction gear.

In a hydraulic motor having an orbiting annular working member having port plates on opposite sides thereof, and where high pressure oil is ported through one port plate to one side of the working member (and thence to one or more working chambers), and wherein low pressure oil is returned from the other side of the working member through the opposite port plate, great and oftentimes fatal difficulties occur as a result of hydraulic unbalances. The port plates tend either to bind against the sides of the working member (which binds the working member or galls the port plates) or to be spread apart from it, with resultant short-circuiting of the pressure fluid. One object of this invention is to provide, in a device of this type, completely hydraulically balanced port plates which bear against the sides of the annular working member with uniform pressure. Thus the same pressure which tends to spread the port plates apart at one point of the motor appears between the plates at a point 180° away.

A comparable problem of hydraulic unbalance is likely to occur with the orbiting working member itself, which tends to cock the member in its bearings, or to shift the rotor axially against one port plate or the other. Thus, another object is to provide a completely balanced working member.

Where an annular series of eccentric bearing members are used to define the orbital or gyrating motion of a working member, it is essential that the bearings be pressure balanced and the bearing surfaces be lubricated with pressure fluid (usually oil) at all times, since these take the entire torque load of the motor. A further object is to provide positive lubrication for the bearing surfaces of each of the eccentric bearings during each orbit of the working member.

These and other objects will be apparent from the following specification and drawings, in which:

FIG. 1 is a vertical cross section through the motor;

FIg. 3 is an elevation of the inner side of a port plate;

FIG. 4 is an elevational view of the outer side of a port plate;

FIG. 5 is a side elevation of the orbiting working member with the vanes and eccentric pin removed;

FIG. 6 is a fragmentary exploded perspective view of part of the orbiting working member and showing one side of an eccentric bearing member;

FIG. 7 is a persepctive view of the other side of eccentric bearing member;

FIG. 8 is a fragmentary detailed view of a check valve in a port plate opposite an end of an eccentric bearing member;

Figure 2:
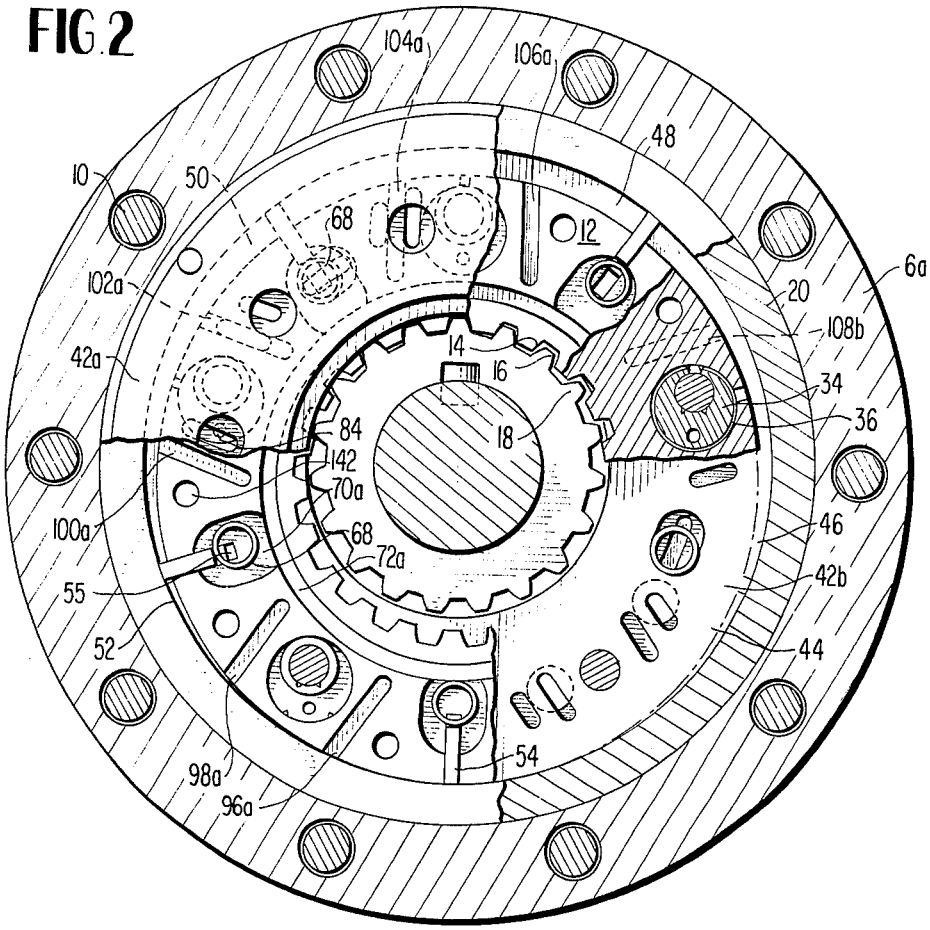
FIG. 2 is a transverse cross section along the line 2—2 of FIG. 1.

FIGS. 10*a* and 10*b* are diagrammatic elevational and corresponding sectional views showing the cooperative action of the ports in the port plate and the grooves in the working member at one phase of one orbit of the working member; and, FIGS. 11*a*, 11*b*, 12*a*, 12*b*, 13*a*, 13*b* and 14*a*, 14*b* are views corresponding to FIGS. 10*a* and 10*b* showing the port and groove action through successive phases of the same orbit.

MECHANICAL MOTION

Referring now to the drawings in which like reference numerals denote similar elements, the motor 2 has a casing 4 consisting of two lobes 6*a* and 6*b* having sandwiched between them a central structure 8, which is clamped between them by through bolts 10. Since the lobes are identical, the suffices "*a*" will be used to designate elements in the left-hand lobe, as seen in FIG. 1, and the suffixes "*b*" will be applied to corresponding elements on the right-hand lobe. In the central structure is an orbiting drive ring 12 having internal teeth 14 which engage, a few at a time, against the external teeth 16 of a pinion 18. The external teeth 16 on the pinion are two less in number than the internal teeth on the drive ring so that each time the drive ring 12 orbits once, the pinion is advanced two teeth distance. Various reductions can be obtained by increasing the number of tooth difference. As will be hereinafter detailed, a hydraulic coupling between drive ring 12 surrounding fixed ring 20 causes the drive ring to oscillate. The driven pinion is keyed as at 22 onto an output shaft 24, the latter rotating in bearings 26*a* and 26*b* and 28, respectively, in lobes 6*a* and 6*b*. Suitable seals 30 prevent leakage fluid from excaping along drive shaft 24 and a removable end plug 32 permits the dirve shaft 24 to be extended outwardly from lobe 6 if desired.

Drive ring 12 is constrained against other than orbital movement by eccentric bearings 34 disposed in cross bores 36 in drive ring 12. Bearings 34 rotate on bearing pins 38 whose ends engage in recesses 40*a*, 40*b* in port plates 42*a* and 42*b*. Five fluid displacement chambers 44, 46, 48, 50 and 52 between the outer periphery of orbiting drive ring 12 and fixed ring 20 are defined by sliding vanes 54 engaged in radial slots 55 in the orbitint drive ring 12. High pressure oil ported into the expanding chambers causes the drive ring to orbit and this rotates output shaft 24.

In FIGS. 3 and 4 the large oval indentations 144 are to provide a support for the roller ring 68 to roll back and forth as the unit oscillates. This roller ring is supported on the inner side by the slot and rides against the vane on its outer side. The smaller of the two oval indentations is to permit the oil to move around and through the roll ring and under the vane. This oil is fed from indentations 70*a* and 70*b* which in turn gets it from grooves 72*a* and 72*b*, which is pressurized through check valve 66.

HYDRAULICS

The two lobes 6*a* and 6*b* and the fluid passages therein are identical as are the port plates 42*a* and 42*b* although, as will be apparent hereinafter, when the port plates are installed in their operative positions, the ports which supply the driving pressure fluid and the ports which exhaust the return low pressure fluid are offset from one another. The lobes each contain a service port 56*a* or 56*b* which leads to an annular trepan port 58*a* or 58*b*. For purposes of exposition it will be assumed that service port 56*a* is connected to a source of high pressure oil (not shown) so that trepan port 58*a* will always be under high pressure and service port 56*b* is connected to the low pressure return line so that trepan port 58*b* will always be under low pressure. The motor can be reversed, of course, by reversing the high and low pressure connections. In the bottom of each lobe, as seen in FIG. 1, there is a scavaging duct 60*a* or 60*b* controlled by a check valve 62*a* or 62*b* so as to drain the interior of the motor casing to which ever of trepan ports 58*a* or 58*b* happens to be connected to the low pressure side of the hydraulic system. Through each port plate are a series, arranged in a circle, of vane ports 64*a* or 64*b* for supplying pressure fluid into slots 55 behind the vanes 54 so that they are always fluid biased to the outer-most possible position. In each port plate is a check valve 66 (detailed in FIG. 8). Thus, although the vane ports 64*a* and 64*b* are directly opposite one another, pressure fluid supplied through the vane ports on one side of the motor (for example, on the left-hand side as seen in FIG. 2) will not escape to the trepan port in the other lobe of the motor, and vice and versa. Bearing rings 68 fitting in counter bores in the inner ends of vane ports 64*a* or 64*b* engage in alcoves 72*a*, 72*b* at the opposite ends of vane slots 55 (FIGS. 2 and 5), and these alcoves communicate, as shown best in FIG. 5, with annular grooves 72*a*, 72*b* on opposite sides of drive ring 12. Thus the annular grooves 72*a* and 72*b* see high pressure oil at all times, regardless of which direction the motor is driven. This is the oil that biases the vanes outwardly. Rings 68 mechanically bias the vanes outwardly also. This is important to the maintenance of hydraulic balance at all times of the drive ring, as well as the "floating" of the port plate which happens to be exposed to the high pressure oil in a trepan port 58*a* or 58*b*. Annular recesses 74*a*, 74*b* and 76*a*, 76*b* on the inner side of trepan ports 58*a* and 58*b* accommodate O-rings 78*a*, 78*b* and 80*a*, 80*b*. These O-rings circumscribe all the ports in the port plates, seal them to their respective lobes, and exert light inward mechanical pressures on the port plates which press them against the opposite sides of the drive ring. The outer periphery of the fixed ring 20 is sealed by O-rings 82*a*, 82*b* against the inwardly facing annular surfaces of the lobes.

Lubrication and axial balancing of the eccentric bearings 34 is assured by means of through passages 84, one end of each receiving high pressure oil for a portion of each orbit of the drive ring 12. In the left-hand portion of FIG. 2 it will be seen that an end of bearing bore 36 is exposed to a port in port plate 42*a*. One of these through passages 84 is exposed to a port in port plate 42*a*, which, in the present context, is a high pressure port. Also, cross bores 36 which accommodate the eccentric bearings are connected by ducts 86 to the periphery of drive ring 12. As is apparent from FIGS. 6 and 7, high pressure oil flowing into either end of a through passage 84 in an eccentric bearing 34 flow through and balances the opposite end. Lubrication is obtained by flow from the ends around and to orifice 86 and visa versa. This oil is prevented from escaping through the port plate on the low-pressure side of the motor because at no time do the opposite ends of through passages 84 see high and low-pressure ports at the same time. This oil is periodically vented to the low-pressure trepan chamber 58*b* via a then-registering port in plate 42*b*. The radial hydraulic balance of the eccentric bearings 34 is also important, since they take the entire torque load of the motor.

The through passage 84 in the eccentric bearing is always in communication from one end of the bearing bore 36 to the opposite end. The eccentric bearing is shorter in length than the bore so each entire end sees the same pressure. When a slit port communicates with this bore (passage 84 connects both ends) oil is immediately in contact with the opposite end. However, only one of the slit ports per each bearing are open to its respective case port 58. This may be the high pressure port (inlet) or the low pressure port (outlet) depending on the position of the oscillator. The slit port in the opposite side in the identical position is a blind one.

If high pressure oil is registering through a slit slot with the eccentric bearing bore (this is always the case with one half of the bores, either two or three, at any particular instant) the expansible chamber on this side will be ported to low pressure. The pressure then builds up within the bearing bore and around the bearing and can only escape through orifice 86 into the outer low pressure region. Conversely, when the bearing bore registers with a low pressure slit slot the expansible chamber is ported to high pressure and high pressure oil enters through orifice 86 and escapes through the low pressure slit slot. This flow is deterred by the closeness of the bearing fit in the bore and is always from the sides of the bearing bore to the center orifice or vice versa.

This oil in the eccentric bearing bore ends is very important in this type device because one-half of the oscillator is being subjected to pressurized inlet oil and the other half to low pressure outlet oil. The inlet oil being under pressure is exerting a greater separation force against the port plates on one side than the other. If it wasn't somehow balanced one-half of the port plate on one side would be metal to metal while the other half would be under pressure to separate. The porting is so constructed to compensate for this. The bearing bores, the high pressure slit slots and the cross over holes are all under pressure on the motor's low pressure side when the expansible chambers are under pressure on the high pressure side. As a result, while one port plate is pressure loaded for 360° toward the opposite plate, the internal forces pushing outwardly from the drive ring are similar in magnitude for 360°. This provides lubrication, sealing and cooling of these surfaces.

Around both sides of the drive ring are a series of ten skewed grooves. These are designated 96*a*, 98*a*, 100*a*, 102*a*, 104*a*, 106*a*, 108*a*, 110*a*, 112*a* and 114*a* (for the grooves in the left-hand side of the drive ring as seen in FIG. 1, and 96*b* through 114*b* for those on the right-hand side). They all communicate with the periphery of the drive ring so that oil can enter and leave the chambers between the drive ring 12 and fixed ring 20 via ports described below.

Around the outer side of each port plate 42*a* or 42*b* are an annular series of shallow circular wells 116*a* or 116*b*, in the bottom of which are alternately long and short slit ports. All the slit ports in the port plates are made as long as possible and still not have contact with the flow in the opposite direction. The short slits are limited in length because they come close to contacting alcoves 70 on the drive ring during one phase of oscillation. To facillitate description, these are each designated by separate reference numerals, 118*a*, 118*b*, 120*a*, 120*b*, 122*a*, 122*b*, 124*a*, 124*b*, 126*a*, 126*b*, 128*a*, 128*b*, 130*a*, 130*b*, 132*a*, 132*b*, 134*a*, 134*b*, 136*a* and 136*b*, the *a* suffix ports being in port plate 42*a* and the *b* suffix ports being in port plate 42*b*. The wells 137 in the outer sides (back side) of the port plates are feeder holes to permit transfer of oil from the large circular ports (58*a* and 58*b*) to the slit slots. The well 139 in each plate contains the check valve FIG. 8 (66) which permits only high pressure oil to enter from that plate which has the high pressure oil behind it. This oil then enters the circular groove 72*a* and 72*b* which ports the oil behind the vanes holding them outwardly against the housing. Adjacent each slit port is a blind port. The blind slit ports appear directly across from the open slit ports in the opposite plate. Their purpose is to balance and keep the oscillator seeing identical pressure patterns on each face. They also help port the flow of oil to and from the expansible chambers. Only blind ports 138*a*, 138*b*, 140*a* and 140*b* will be designated. Although the port plates are identical, because of the port pattern, no slit port in one plate lies directly opposite another slit port on the other plate when the plates are arranged opposite one another. This is because when they face each other the slits are off side in opposite directions. On the contrary, opposite each slit port on one plate lies a blind port on the opposite plate. Thus, at any given time when pressure fluid is fed through certain of the ports in one plate and through communicating grooves on one side of the drive ring to the expanding chambers, none of the grooves lying directly opposite on the other side of the drive ring are then in communication with a through slit port in the opposite port plate. However, they are always in communication one through port to its opposite blind port.

Figure 9:
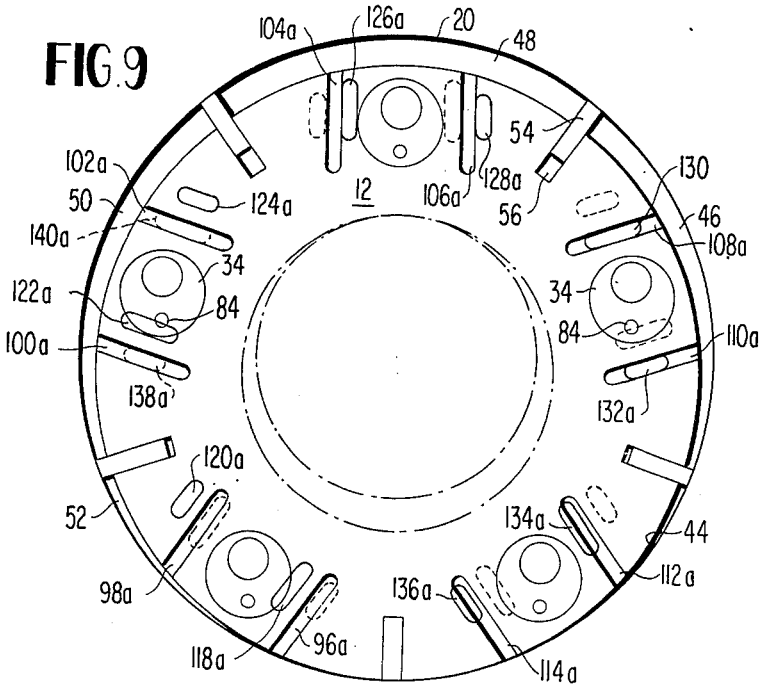
FIG. 9 is a diagrammatic view of one side of the working member showing the divider vane action and the exposure of the fluid-conducting grooves to the ports of the port plates.

The porting and hydraulic drive action is diagrammatically illustrated in FIGS. 9 and 10*a* through 14*b*. In FIG. 9 it will be apparent that chamber 44 is being pressurized through slit ports 136*a*, 134*a* which are in partial communication with grooves 114*a* and 112*a*. Chamber 46 is being pressurized through ports 132*a* and 130*a* which are then directly over grooves 110*a* and 108*a*. At that phase of the orbit of drive ring 12, which will be assumed to be in the direction of the arrow in FIG. 9, no fluid flows to or from chamber 48. Chamber 40 is then contracting and low pressure fluid flows out grooves 102*b* and 100*b* and then-communicating ports in port plate 42*b*. Chamber 52 is almost contracted and low pressure fluid is then exhausting via grooves 98*b* and 96*b* through the open slit ports in port plate 42*b*. On the right hand side of FIG. 9 it will be apparent that a through passage 84 in an eccentric bearing 34 communicates with an open port in port plate 42*b* to what has been assumed to be the low pressure side of the motor, while an almost opposite through passage 84 is being charged with high pressure fluid through port 122*a*.

Cross bores 142 extend through the drive ring from one side to the other. They each communicate with one blind spot in one port plate and one open slot in the opposite port plate. They serve to provide oil to the blind slot from its open opposite member. The eccentric bearing bore and passage 84 through the bearing serve this purpose for the slots closest to the bearing bore.

FIGS. 10*a* through 14*b* illustrate the action of one chamber 50 and the associated ports and grooves during one complete orbit of port plate 12. In FIGS. 10*a* and 10*b*, chamber 50 is contracting and fluid is exhausting via grooves 102*a* and 102*b* and ports 122*b* and 124*b* in port plate 42*b*. The opposite grooves 100*a*, 102*a* are then partly opposite blind ports 138*a* and 140*a* and hence there is no fluid flow through slit ports 122*a* and 124*a*.

In the next phase of the orbit cycle, chamber 50 has contracted further, fluid is still exhausting via grooves 100*b*, 102*b* and ports 122*b* and 124*b*. There is still no flow to or from chamber 50 because grooves 100*a* and 102*a* are then directly opposite blind ports 138*a* and 140*a*.

In the FIG. 11*a* condition, it will be seen that bearing bore 36 and hence through passage 84 in eccentric bearing 34 is being charged with high pressure oil via port 122*a*, beneath which the through passage then lies.

In the FIG. 12*a* position, chamber 50 has almost contracted and fluid is still exhausting via grooves 100*b*, 102*b* and ports 122*b*, 124*b* with which the *b* grooves are still in communication.

In the condition of FIGS. 13*a* and 13*b*, all ports and grooves are blocked and no fluid flows to or from chamber 50. In FIGS. 14*a* and 14*b*, chamber 50 has started to expand and pressure fluid flows thereto via ports 122*a* and 124*a* in port plate 42*a* and grooves 100*a*, 102*a* which then are registry behind the ports.

In the FIG. 11*a* phase, the bearing bore 36 and through passage 84 in eccentric bearing 34 communicate with port 124*b* in port plate 42*b*. Because of through passages 84, the ends of the eccentric bearings receive lubricating oil through a port in port plate 42*a* during each orbit of the drive ring and the ends of the eccentric bearings are hydraulically balanced in their axial directions at all time. Because of the ducts 86, oil from the fluid coupling chambers alternately pressurizes the grooves in the eccentric bearings to balance off the transfer of torque on the pressure side and, because of grooves 85, 88 and 90, all the bearing surfaces are lubricated. The process is continuously alternating from one direction to the other which keeps the bearing under continuous pressure.

The O-rings 74*a*, 76*a* and 74*b*, 76*b* behind the port plates are spaced such that the oil pressure between them balances the oil pressure ported to the drive ring. The pressure which would normally deflect the port plates outwardly is balanced by the oil pressure between the O-rings. Only one side of the motor has oil under pressure, depending upon which service port 56*a* or 56*b* is used as the high pressure inlet. Because the port plate on the high pressure side is pressurized all around between the O-rings and because the drive ring is only pressurized for one-half of its area, the eccentric bearings pressure slits and cross holes are pressurized on the outlet or low pressure side. This enables the eccentric bearings to be pressure loaded and hence lubricated and also, because the side areas are pressurized, the drive ring is balanced axially between the port plates. The oil is permitted to go through the eccentric bearing via groove 85 in the cross bores 36, but it is prohibited from escaping to the low-pressure trepan chamber at the time it is being pressurized because the then opposite port is blind. It flows around the bearing, lubricates, cools and leaks out orifice 86 or vice versa.

I claim:

1. An orbital drive fluid motor comprising a casing defining a cavity bonded by an inwardly facing annular surface, a rotatable drive shaft extending through said cavity and having a pinion thereon, an annular drive member having an inner periphery larger than and surrounding said pinion with teeth thereon which are more in number than the teeth on said pinion, an outer periphery surrounded by and smaller in diameter than the annular surface bonding said chamber, and opposite end surfaces, a pair of port plates having inner surfaces respectively disposed against the end surfaces of said drive member and having limited freedom of movement towards and away from the same, a plurality of divider means extending between the outer periphery of the drive member and the surrounding annular surface and providing therebetween a plurality of fluid coupling chambers, a plurality of eccentric bearing members extending through bores through said drive member from end-to-end thereof and having opposite ends thereof supported in said port plates, said bearing members restraining said drive members against other than orbital movement wherein the teeth on the inner periphery thereof engage the teeth a few at a time of the pinion and wherein fluid coupling chambers on one side of the drive member undergo expansive phases while those on the opposite side undergo contractile phrases, said drive member having on opposite ends thereof slots which terminate at said fluid coupling chambers, said casing having trepan chambers on each outer side of said port plates, one of which is for connection with a high pressure fluid supply line while the other is for connection with a low pressure fluid return line, said port plates having therethrough ports, those on one of which plates register with slots terminating in fluid coupling chambers on one end of said drive members and connect the same with one of said trepan chambers while those on the other plate connect said fluid coupling chambers on the other side of said drive member with the other trepan chamber, means for hydraulically balancing the opposite sides of said port plates, and means for charging the bearing bores with fluid from said fluid coupling chambers.

2. A fluid motor as claimed in claim 1, the means for charging said bores with fluid from said fluid coupling chambers comprising passages extending from the outer periphery of said drive member to said bores.

3. A fluid motor as claimed in claim 1, said divider means comprising radial vanes movably disposed in aperaures in said drive members, said apertures terminating at opposite ends in recesses in the ends of said drive member, said drive member having an annular groove in each end thereof disposed inwardly radially of the recesses and in communication therewith, and port means through said port plates and having inwardly-opening check valves for establishing communication between the trepan chamber which is charged with high-pressure fluid and at least one of said recesses, whereby all of said vane apertures are charged with high pressure fluid for forcing them outwardly.

4. A fluid motor as claimed in claim 1, wherein the ports in one port plate are opposite lands between the ports in the other port plate, said eccentric bearing member having fluid passages therethrough which register with the ports in one port and then with ports in the other port plate as said drive member undergoes orbital movement, whereby the ends of said bearing member are sequentially charged with and relieved of high-pressure oil during each orbit of the drive member.

5. A fluid motor as claimed in claim 1, the means for mechanically biasing said port plates inwardly towards adjacent ends of said drive member comprising O-rings disposed in recesses surrounding ports in said port plates and compressed between the outer sides of said port plates and opposing surfaces on said casing.

6. A fluid motor as claimed in claim 1, wherein the means for hydraulically balancing the opposite sides of said port plates including means for maintaining equal fluid pressure on 360° of the inner surfaces of said port plates.

7. A fluid motor as claimed in claim 6, and means for mechanically biasing said port plates inwardly towards said drive member.

* * * * *